US012611001B2

(12) United States Patent
Cobb

(10) Patent No.: US 12,611,001 B2
(45) Date of Patent: Apr. 28, 2026

(54) SANDAL CONSTRUCTION

(71) Applicant: Wolverine Outdoors, Inc., Rockford, MI (US)

(72) Inventor: Ian M. Cobb, Rockford, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

(21) Appl. No.: 19/240,212

(22) Filed: Jun. 17, 2025

(65) Prior Publication Data

US 2025/0366559 A1 Dec. 4, 2025

Related U.S. Application Data

(63) Continuation of application No. 18/613,602, filed on Mar. 22, 2024, now Pat. No. 12,349,764.

(51) Int. Cl.
*A43B 3/12* (2006.01)

(52) U.S. Cl.
CPC ..... *A43B 3/126* (2013.01); *A43B 3/12* (2013.01); *A43B 3/122* (2013.01); *A43B 3/128* (2013.01)

(58) Field of Classification Search
CPC ..... A43B 3/12; A43B 3/126; A43B 3/128
USPC ..... 36/11.5
See application file for complete search history.

(56) References Cited

U.S. PATENT DOCUMENTS

| | | | | |
|---|---|---|---|---|
| 2,090,675 | A * | 8/1937 | Hadaway | A43B 3/126 36/43 |
| 4,200,997 | A * | 5/1980 | Scheinhaus | A43C 11/1493 36/11.5 |
| 4,446,633 | A * | 5/1984 | Scheinhaus | A43B 7/24 D2/916 |
| 5,205,054 | A * | 4/1993 | York, Jr. | A43B 3/126 36/11.5 |
| 5,438,767 | A * | 8/1995 | Stein | A43B 7/142 D2/916 |
| 6,237,250 | B1 * | 5/2001 | Aguerre | A43B 3/122 36/11.5 |
| 6,606,803 | B1 * | 8/2003 | Ritter | A43C 11/1493 D2/916 |
| 6,694,641 | B1 * | 2/2004 | Gill | A43B 7/1445 36/11.5 |
| 12,349,764 | B1 * | 7/2025 | Cobb | A43B 3/126 |

(Continued)

*Primary Examiner* — Marie D Bays
(74) *Attorney, Agent, or Firm* — Warner Norcross + Judd LLP

(57) ABSTRACT

A sandal construction providing lightweight, highly adjustable sandals. The sandal includes an EVA midsole configured to receive the wearers footwear and an outsole configured to engage the ground. The sandal includes an upper having a heel assembly that seats the heel of the wearer's foot and a strap that retains the forward portion of the wearer's foot. The forefoot strap is a single, adjustable length strap that passes over the wearer's foot and is slidably threaded through passages in the sole. The midsole includes embedded strap inserts that define portions of the passages to receive and facilitate lengthwise movement of the strap. The strap inserts are substantially more rigid than the EVA. Each strap insert may include a web shepherding the strap across the bottom of the midsole and a pair of upright sleeves that shepherd the strap through at least a portion of the thickness of the midsole.

20 Claims, 7 Drawing Sheets

(56) References Cited

U.S. PATENT DOCUMENTS

| | | | | |
|---|---|---|---|---|
| 2002/0124433 | A1* | 9/2002 | Pan | A43B 3/122 36/11.5 |
| 2003/0074806 | A1* | 4/2003 | Urie | A43B 3/126 36/11.5 |
| 2005/0268485 | A1* | 12/2005 | Sakai | A43B 7/18 36/11.5 |
| 2019/0350304 | A1* | 11/2019 | Velazquez | B32B 25/08 |
| 2020/0138147 | A1* | 5/2020 | Fogg | A43C 1/00 |

* cited by examiner

SANDAL CONSTRUCTION

BACKGROUND OF THE INVENTION

The present invention relates to footwear and more particularly to the construction of sandals.

Sandals are an important category of footwear sold throughout most of the world, particularly in hot and temperate climates. Although sandals are available in a wide variety of types and styles, sandals are typically characterized by a generally open upper that is secured to a sole. A sandal upper is commonly manufactured from one or more straps or segments of fabric that are anchored to the sole and are configured to wrap one or more parts of the wearer's foot. For example, a wide range of sandals includes a heel assembly that is configured to seat the wearer's heel and one ore more straps (or strap-like components) that cross over the midfoot and/or forefoot portion of the sole.

In one conventional construction, a sandal is provided with a heel assembly that wraps about the heel and a single adjustable-length strap is laced through a number of passages in the midsole to form a series of loops over the sole. The loops are configured to receive and hold the wearer's foot forward of the ankle. To allow a broad range of adjustment to the size of the loops, the strap is fitted through the passages in a way that allows movement of the strap in a lengthwise direction. While a marked improvement over many other types of sandal constructions, the sole is manufactured from a material that is relatively firm and relatively heavy material to permit lengthwise movement of the strap relative to the sole even when the midsole is being worn and compressed under the weight of the wearer.

As a result, there remains a long-felt and unmet need for improvements in the construction of sandals.

SUMMARY OF THE INVENTION

The present invention provides a sandal construction that is not only lightweight, but is also highly adjustable and provides a relatively high degree of cushioning. The sandal includes a multilayer sole with a rubber outsole configured to engage the ground and an EVA midsole configured to receive the wearer's footwear. The sandal also includes an upper having a heel assembly that seats the heel of the wearer's foot and a forefoot strap that retains the forward portion of the wearer's foot. The forefoot strap is a single, adjustable length strap that passes over the wearer's foot and is slidably threaded through passages in the sole. The midsole includes a pair of embedded strap inserts that define at least portions of the passages in the sole and are configured to receive and guide the movable forefoot strap. The strap inserts are substantially more rigid than the EVA and therefore facilitate movement of the adjustable strap even when the midsole is compressed under the weight of a wearer. Each strap insert includes a web configured to shepherd the strap across the bottom of the midsole and a pair of upright sleeves that guide the strap through at least a portion of the thickness of the midsole.

In one embodiment, the web is shaped to define a downwardly opening channel along which the strap extends in a generally lateral direction across the bottom of the midsole. The depth of the channel may be roughly equal to or slightly greater than the thickness of the strap. Similarly, the width of the channel may be roughly equal to or slightly greater than the width of the strap.

In one embodiment, each upright sleeve defines a vertical passage through which the strap extends vertically through the midsole. Each passage may have a generally rectangular cross-section that corresponds with or is slightly greater than the cross-sectional shape of the strap. In one embodiment, the upright sleeves extend only partially through the thickness of the midsole. For example, in one embodiment, the upper end of the uprights is recessed below the upper surface of the midsole by about 3 mm to about 4 mm, though the precise difference may vary from application to application.

In one embodiment, the web of each strap insert is perforated and the midsole and strap inserts are intimately joined together through a compression molding process. In one embodiment, the openings are arranged in a regular repeating pattern and have an area of approximately 4 $mm^2$ to about 25 $mm^2$, though the arrangement and size of the openings may vary.

In one embodiment, the strap inserts are positioned in a compression mold and then the midsole material is compression molded under heat and pressure into the desired shape directly in contact with the strap inserts. The compression molding process causes the midsole material (e.g. EVA) to join directly to the mating surfaces of the strap inserts. In alternative applications, the strap inserts may additionally or alternatively be secured to the midsole by cement or other adhesives. The mold part receiving the strap inserts may include mating features configured to be fitted into the recess in the web and through the interior of the upright sleeves. The mold part features may continue vertically beyond the upper end of the upright sleeves and function as a core to define the remainder of the vertical passages through the midsole (e.g. through the midsole material overlaying the upper ends of the upright sleeves).

In one embodiment, the strap inserts are manufactured from a relatively rigid polymeric material, such as TPU. The precise characteristics of the TPU may vary from application to application.

In one embodiment, the midsole is molded with a three-dimensional shape that is anatomically correct and is configured to support the undersurface of the wearer's foot. For example, the upper surface of the sole may be configured to mirror the shape of the undersurface of a typical wearer's foot. The sole may include a heel recess, a central arch support and a generally planar forefoot region. The heel recess may be positioned to help seat the heel of the wearer's foot when the wearer's foot is properly engaged with the three-dimensional heel strap.

In one embodiment, the heel assembly generally includes a pair of vertical posts that are affixed to the sole and extend upwardly along opposite sides of the heel and a horizontal heel strap that wraps around the rear of wearer's foot. The heel assembly may be configured so that the heel strap engages the rear of the wearer's foot above the calcaneus. The posts and heel strap may be integral parts of a one-piece component or they may be separate components that are joined together during assembly. For example, the heel assembly may be manufactured by laminated together at least one structural layer, at least one padding layer and a lining material.

The present invention provides a simple and effective sandal construction that allows an upper with adjustable strap to be incorporated into a midsole formed from a light-weight material having a high degree of cushioning, such as EVA. The strap inserts define relatively rigid passages that facilitate movement of the straps through the midsole even when the midsole is compressed, thereby allowing easier adjustment of the strap relative to the sole. The use of forefoot and midfoot strap inserts allows the strap to pass through the midsole once in the forefoot region and once in the midfoot region. Each strap insert may include a web and a pair of upright sleeves that mate with the strap along a majority of the passage through the midsole. The upright sleeves may terminate short of the top surface of the midsole to protect from the sleeves being felt by the wearer's foot. The web may be perforated to enhance the bond between the strap inserts and the midsole, thereby improving performance and durability of the sole. To facilitate manufacture and provide a durable connection between the midsole and the strap inserts, the midsole may be formed by a compression molding process in which the strap inserts are fitted into a compression mold and joined to the midsole as an integral part of the midsole compression molding process.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Overview.

Figure 1:
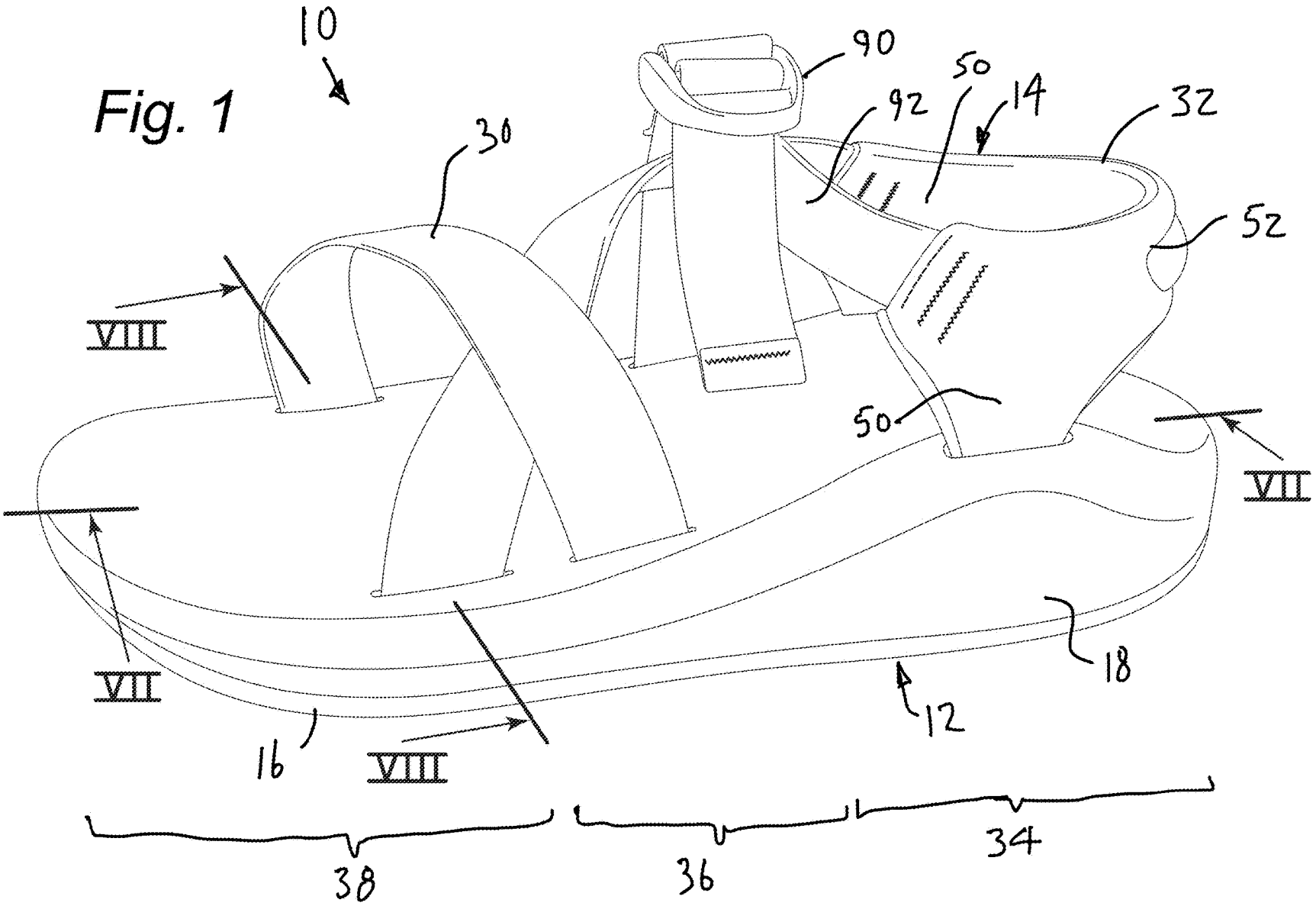
FIG. 1 is a perspective view of a sandal incorporating an embodiment of the present invention.

A sandal constructed in accordance with a preferred embodiment of the present invention is shown in FIG. 1 and generally designated 10. In general, the sandal 10 includes a sole 12 and an upper 14. The sole 12 generally includes an outsole 16, a midsole 18 and a pair of strap inserts 20*a-b* embedded within the midsole 18. The outsole 16 is manufactured from a durable material, such as rubber, and is configured to engage the ground. The midsole 18 is affixed to the top of the outsole 16 and is manufactured from a lightweight cushioning material, such as EVA. The strap inserts 20*a-b* are manufactured from a relatively rigid polymeric material, such as TPU. The upper 14 generally includes an adjustable-length strap 30 and a heel assembly 32. The heel assembly 32 is affixed to the sole 12 in the heel region. The strap 30 is affixed to the heel assembly 32 and is laced through the midsole 18 to form loops above the midsole 18 that cross back and forth over the forefoot and midfoot to retain a wearer's foot on the sole 12. The strap inserts 20*a-b* are embedded in midsole to define passages through which the strap 30 passes through the midsole. Each strap insert 20*a-b* includes a web 60 and a pair of upright sleeves 62. The web extends along the undersurface of the midsole and the upright sleeves 62 extend vertically through all or a portion the vertical thickness of the midsole.

The sandal 10 of FIG. 1 is merely exemplary and the various aspects of the present invention may be incorporated into a wide range of alternative sandal constructions, including sandals with alternative sole constructions and/or alternative upper constructions. The illustrated sandal 10 is intended to be worn on the left foot and will be described in detail. Of course, a sandal intended to be worn on the right foot may be a mirror image of the illustrated sandal 10. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

Construction of Illustrated Embodiment

Figure 2:
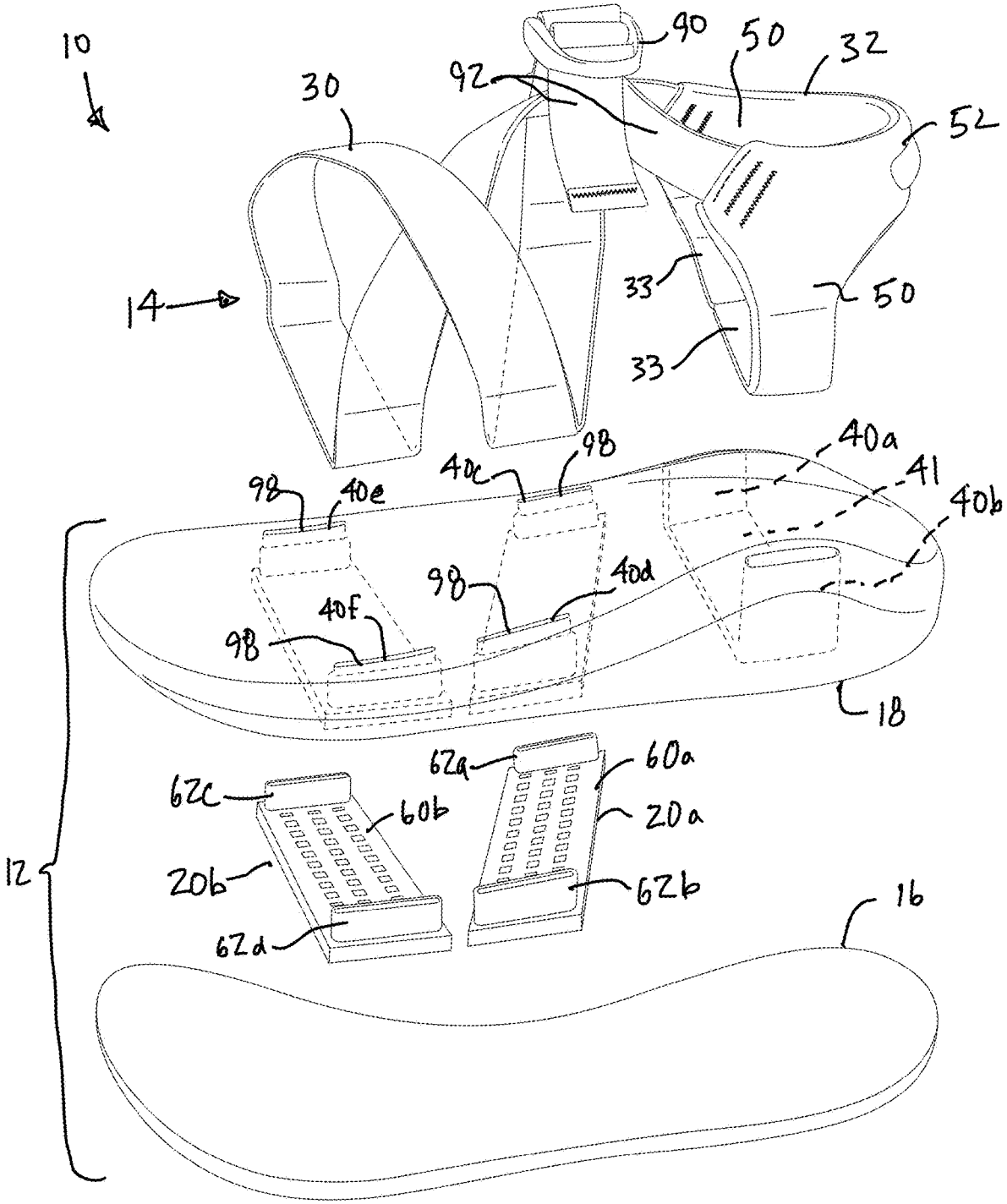
FIG. 2 is an exploded view of the sandal.

As noted above, the sandal 10 of FIG. 1 generally includes a sole 12 and an upper 14 that are interconnected to form an article of footwear. FIG. 2 is an exploded view of the sandal 10 showing various parts of the sandal 10. The sole 12 generally includes an outsole 16, a midsole 18, a midfoot strap insert 20*a* and forefoot strap insert 20*b*.

In this embodiment, the outsole 16 forms the ground-engaging layer of the sandal 10. The outsole 16 of FIG. 1 is generally conventional and is made of a conventional outsole material (such as rubber, a rubber compound or a similar material) that are selected to provide the desired balance between comfort, wear and traction. Although the outsole 16 may be manufactured from a conventional rubber compound, a variety of other materials may be used to provide the desired comfort, wear and traction. The bottom surface of the outsole 16 may include treads, lugs or otherwise be configured to enhance traction. The design and configuration of the outsole 16 may vary from application to application as desired. For example, the outsole 16 may be formed by a plurality of separate portions that are affixed to the undersurface of the midsole 18, such as separate heel and forefoot portions that are spaced apart from one another in the arch region.

Figure 7:
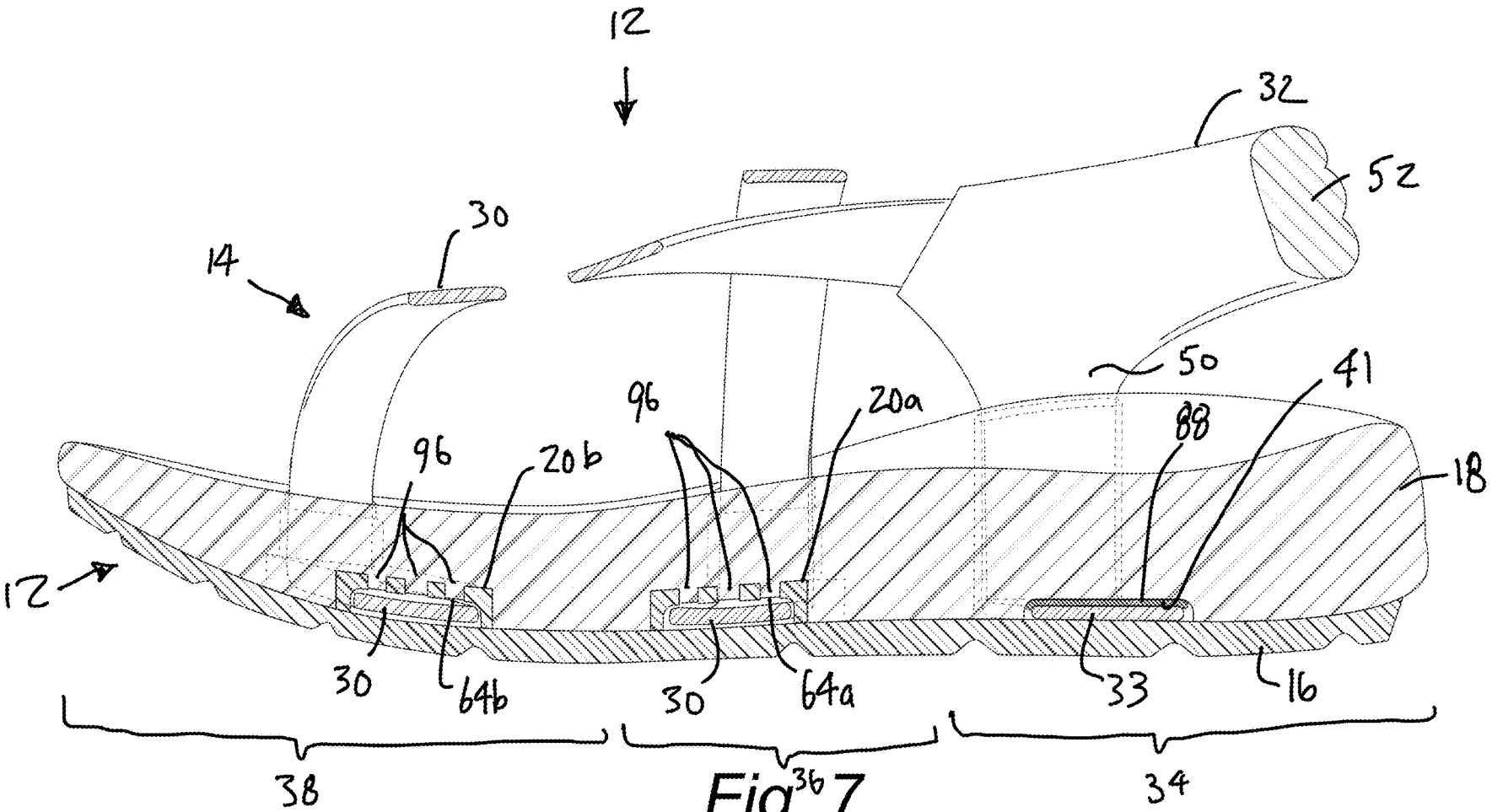
FIG. 7 is a sectional view of the sole taken along line VII-VII of FIG. 1.

The midsole 18 of the illustrated embodiment is affixed to the top surface of the outsole 16 and is of a one-piece construction. In the embodiment of FIG. 1, the midsole 18 is manufactured from EVA (or other similar materials, such as PU) having a hardness of about 48+/−4 Shore C, but the specific characteristics of the midsole material may vary from application to application. For example, the midsole may be compression molded from EVA with the finished midsole having a hardness in the range of about 40 Shore C to about 56 Shore C. As shown in FIG. 1, the top surface of the midsole 18 has a three-dimensional shape intended to follow the anatomical shape of a typical wearer's foot. For example, the upper surface of the midsole 18 may be configured to mirror the shape of the undersurface of a typical wearer's foot. As shown in FIGS. 1 and 7, the upper surface of the midsole 18 may include a heel region 34, a midfoot region 36 and a forefoot region 38. The heel region 34 may include a gradual recess that is positioned to help center or otherwise properly position the heel of the wearer's foot in the heel region 34.

The midsole 18 is configured to receive the upper 14 in an arrangement that allows the upper 14 to secure the wearer's foot to the sole 12. More specifically, the midsole 18 is configured so that the heel assembly 32 can be attached in the heel region 34 of the midsole 18 and the strap 30 can be attached in the midfoot region 36 and the forefoot region 38 of the midsole 18. In the illustrated embodiment, the strap 30 and heel assembly 32 are attached to midsole 18 in part through various passages that extend through the thickness of the midsole. The midsole 18 of the illustrated embodiment defines a pair of through-slots 40*a-b* that facilitate attachment of the heel assembly 32. The heel assembly through-slots 40*a-b* are disposed in the heel region 36 on opposite sides (i.e. lateral and medial sides) of the midsole 18. In this embodiment, a shallow recess 41 is defined along the bottom of the midsole 18 joining the heel assembly through-slots 40*a-b*. In this embodiment, the heel assembly through-slots 40*a-b* and the heel assembly recess 41 are defined to closely receive the attachment ends 33 of the heel assembly 32 as described in more detail below. The midsole 18 also defines a pair of midfoot through-slots 40*c-d* and a pair of forefoot through-slots 40*e-f* that are configured to receive the strap 30 (discussed in more detail below). Each of the through-slots 40*c-f* are shaped to allow a portion of the strap 30 to pass through the thickness of the midsole 18. As can be seen, the midfoot and forefoot through-slots 40*c-f* closely correspond in size and shape with the cross-sectional size and shape of the material used to form the strap 30.

Figure 3:
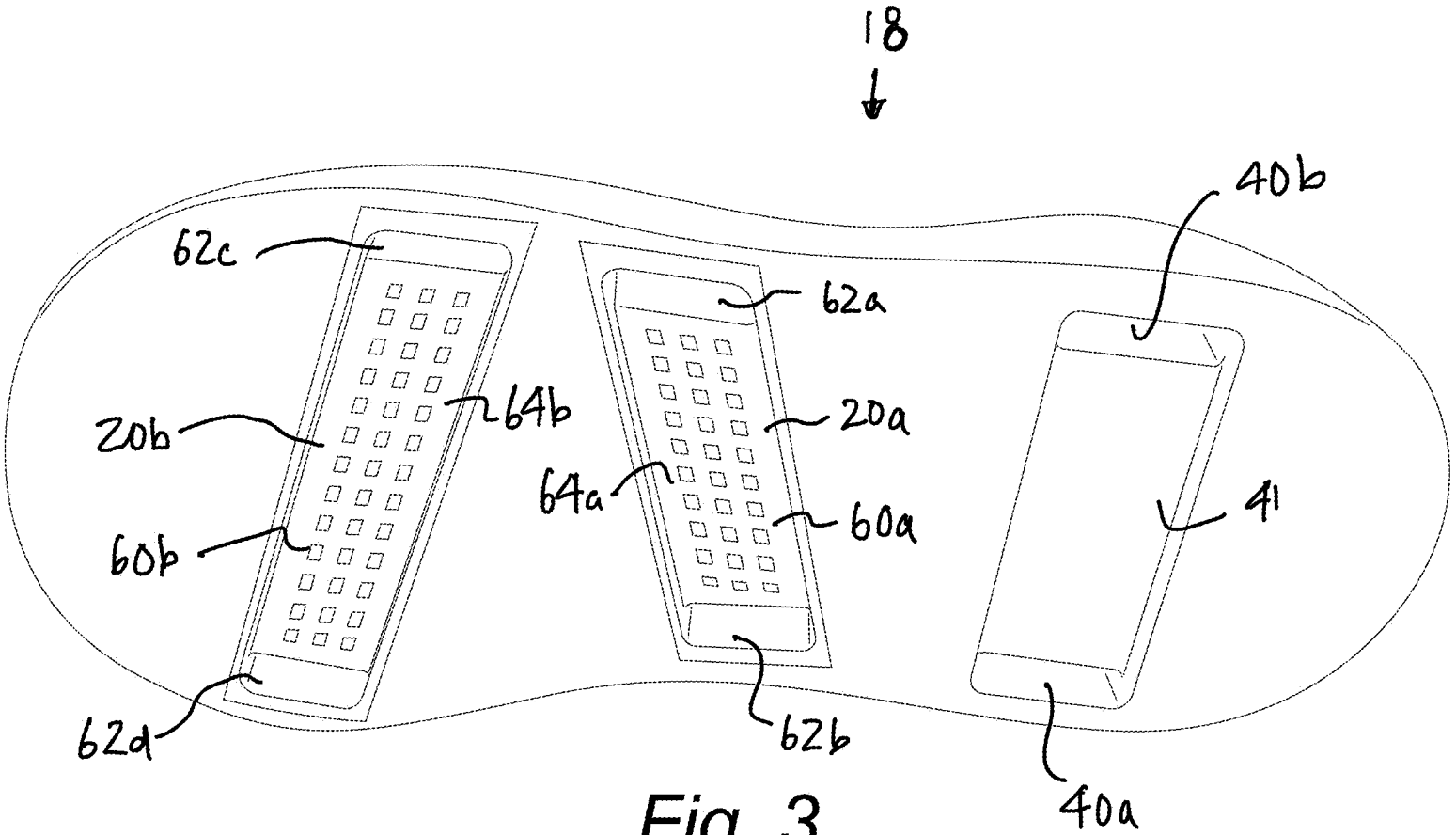
FIG. 3 is a bottom perspective view of the midsole with the strap inserts.
Figure 4:
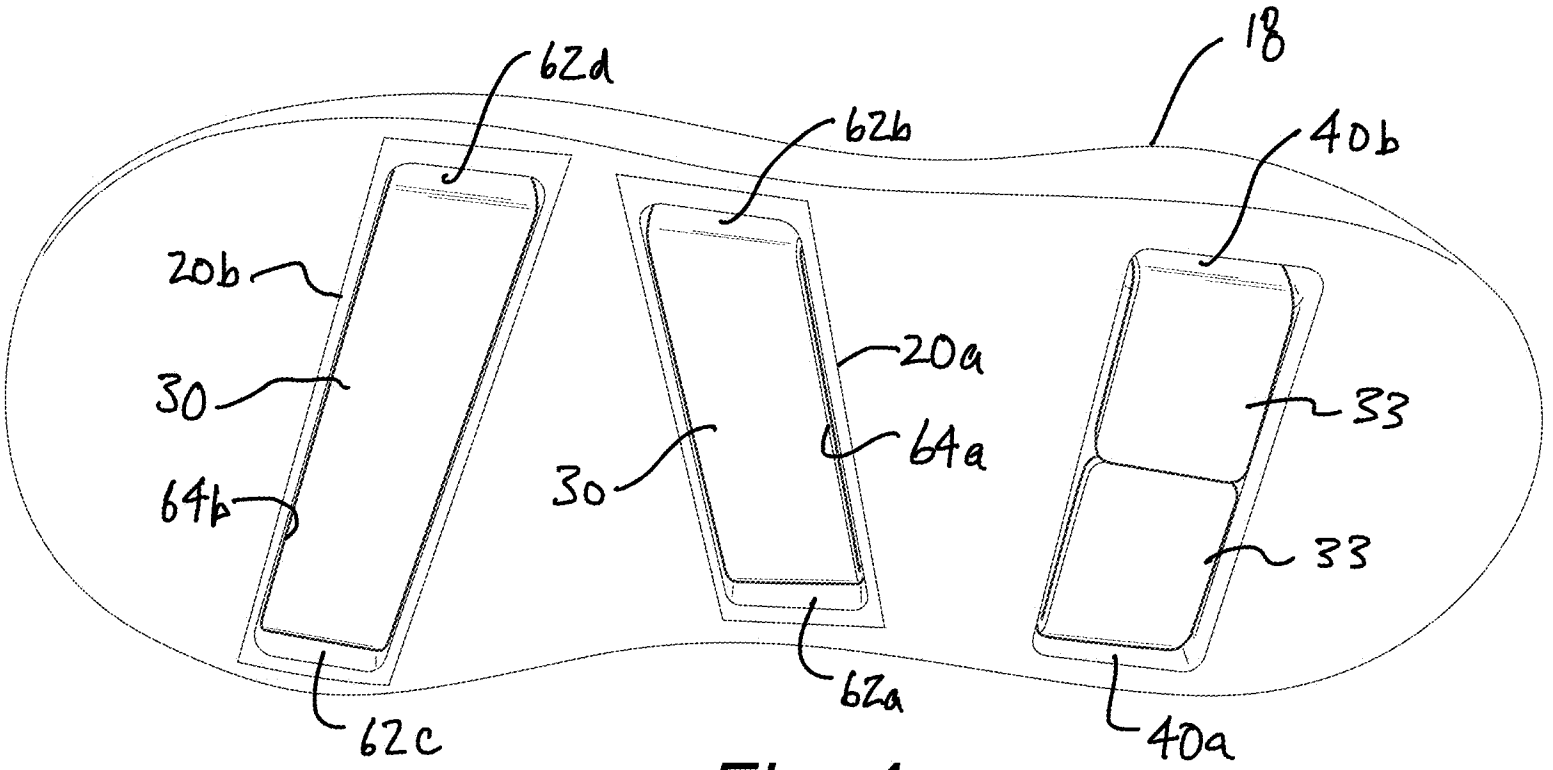
FIG. 4 is a bottom perspective view similar to FIG. 3, except showing the straps extending through the strap inserts.

In the illustrated embodiment, the upper 12 includes a strap 30 affixed at one end to the lateral side of the heel assembly 32 and at the opposite end to the medial side of the heel assembly 32. The length of the strap 30 is laced through the midsole 18, for example, once in the midfoot region 36 and once in the forefoot region 38. In the illustrated embodiment, the strap 30 is arranged in a configuration that forms strap loops that criss-cross once over the forefoot of the wearer's foot and criss-cross again over the midfoot region adjacent to the ankle. The configuration of the strap 30 may vary from application to application to, for example, change the size, shape, orientation and relative position of the strap loops. To permit adjustment of the strap 30 (for example, individual adjustment of the size of the loops) the strap 30 is threaded through the through-slots 40*c-f* and extends across the bottom of the midsole 18 in a manner that allows lengthwise movement of the strap 30. To facilitate this lengthwise adjustment, the sole 12 includes a number of strap inserts 20*a-b* that are embedded within the midsole 18 and define a majority of the strap pathways through the midsole 18. The strap inserts 20*a-b* are manufactured from a relatively rigid material that allows the strap 30 to move more easily within the strap pathways—even when the midsole 18 is being compressed when worn. In the illustrated embodiment, the midsole 18 is fitted with two strap inserts 20*a-b*, including a midfoot strap insert 20*a* and a forefoot strap insert 20*b*. The strap inserts 20*a-b* are embedded into the midsole 18 from the bottom, with the bottom of the strap inserts 20*a-b* extending essentially flush with the bottom surface of the midsole 18. Each strap insert 20*a-b* generally includes a web 60*a-b* that terminates at each end in an upright sleeve 62*a-d*. The web 60*a-b* is configured to extend at the desired angle across a majority of the width of the bottom of the midsole 18. For example, in the illustrated embodiment, the web 60*a* of the midfoot strap insert 20*a* extends across the midsole 18 forwardly from the medial side to the lateral side at an angle of about 20 degrees, or in the range of about 0 degrees to about 40 degrees. Similarly, the web 60*b* of the forefoot strap insert 20*b* extends across the midsole 18 forwardly from the lateral side to the medial side at an angle of about 25 degrees, or in the range of about 0 degrees to about 45 degrees. As shown in FIGS. 3 and 7, each web 60*a-b* is shaped to form a recessed channel 64*a-b*. The recessed channels 64*a-b* are size and shaped to be about the same size as or slightly larger than the strap 30. For example, in the illustrated embodiment, the strap 30 has a generally rectangular cross section and the recessed channels 64*a-b* each has a corresponding or slightly larger rectangular cross section. In the fully assembled sandal 10, the outsole 16 is joined to the bottom surface of the midsole 18 with the outsole 16 closing the bottom of the recessed channels 64*a-b* and entrapping the strap 30 in the recessed channels 64*a-b*.

In the illustrated embodiment, the web 60*a-b* of each strap insert 20*a-b* is perforated, and the midsole 18 and strap inserts 20*a-b* are intimately joined together as an integral part of a compression molding process. As perhaps best shown in FIGS. 2 and 3, the perforations 96 are generally rectangular and are arranged in a regular repeating pattern. In this embodiment, each perforation 96 has an area of approximately about 4 $mm^2$ to about 25 $mm^2$. The size, shape and arrangement of perforations 96 may vary from application to application. As discussed in more detail below, the strap inserts 20*a-b* of the illustrated embodiment are positioned in a compression mold and then the midsole material preform is placed in the mold and compression molded under heat and pressure into the desired shape in intimate contact with the strap inserts 20*a-b*. This in-situ compression molding process causes the midsole material to join directly to the mating surfaces of the strap inserts 20*a-b*, which is increased by the presence of the perforations 96. In alternative applications, the strap inserts 20*a-b* may additionally or alternatively be secured to the midsole 18 by cement or other adhesives.

Figure 5:
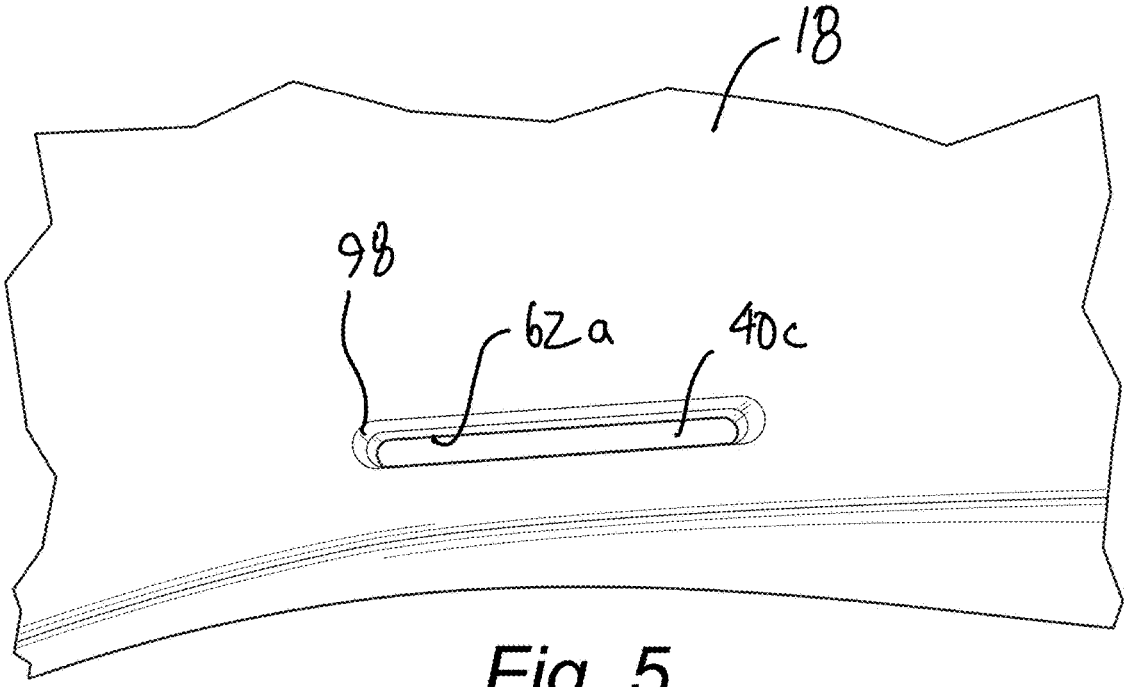
FIG. 5 is a perspective view of a portion of the midsole showing a medial strap passage.
Figure 6:
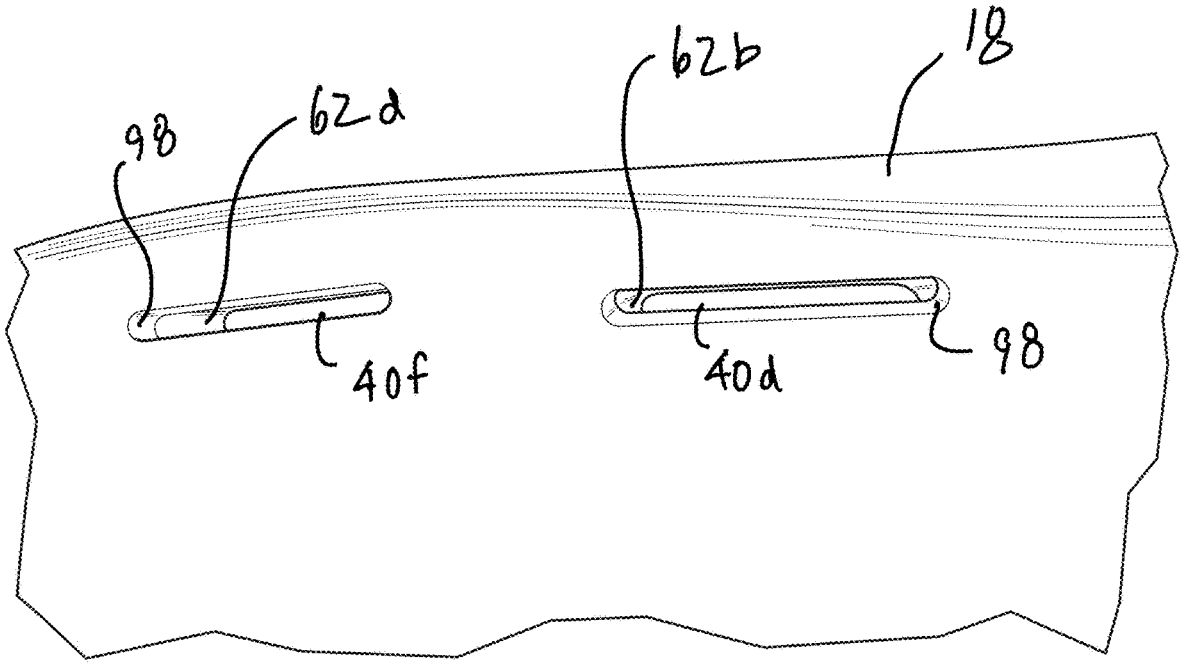
FIG. 6 is a perspective view of a portion of the midsole showing two lateral strap passages.

The upright sleeves 62*a-d* each define a vertical (or somewhat vertical) passage through which the strap extends vertically (or somewhat vertically) through at least a portion of the vertical thickness of the midsole 18. The vertical passages through the upright sleeves 62*a-d* may have a generally rectangular cross-section that corresponds with or is slightly greater than the cross-sectional shape of the strap. In this embodiment, the narrow edges of the strap 30 and the short edges of the generally rectangular cross-section of the upright sleeves 62*a-d* are curved, for example, having a constant radius of curvature defined by the spacing between the longer edges of the cross-section. It should be understood that the cross-sections of the strap and the vertical passages need not be precisely matched, but may vary substantially in some alternative applications. In the illustrated embodiment, the upright sleeves 62*a-d* extend only partially through the thickness of the midsole 18. In such applications, the midsole 18 defines supplemental slots 98 that are aligned with and complete the passageway through the thickness of the midsole 18. As shown in FIGS. 5 and 6, the upper end of each upright sleeves 62*a-d* is, in the illustrated embodiment, recessed below the upper surface of the midsole 18 by about 3 mm to about 4 mm. This reduces the potential for the wearer to feel the more rigid strap inserts 20*a-b* when wearing the sandals 10. In alternative applications, the height of the upright sleeves 62*a-d* relative to the height of the midsole 18 may vary from application to application and/or from location to location within a given midsole. In some alternative applications, the upper ends of the upright sleeves 62*a-d* may be flush with the upper surface of the midsole 18 or may be even extend above the upper surface of the midsole 18.

In the illustrated embodiment, the corner 86 defined by the mating surfaces of each upright sleeve 62*a-d* and the adjacent connected web 60*a-b* is rounded. Rounding these corners 86 facilitates movements of the strap 30 about the corners 86 and reduces the potential for wear of the strap 30 at the corners. The radius of curvature of the corners 86 may vary from application to application.

As noted above, the strap inserts 20*a-b* are manufactured from a relatively rigid polymeric material, such as TPU. For example, the strap inserts 20*a-b* may be injection molded from TPU having a hardness in the range of 90 Shore A or in the range of about 80 Shore A to about 100 Shore A. The noted characteristics of the strap inserts are merely exemplary and the precise characteristics may vary from application to application.

In the illustrated embodiment, the sandal includes two strap inserts (i.e. strap inserts 20*a* and 20*b*)—one extending across the midfoot region and the other extending across the forefoot region. In alternative applications, the number and location of the strap inserts may vary to allow the strap to be threaded through the midsole a different number of times and/or at different locations.

As discussed above, the upper 14 is affixed to the sole 12 to provide a structure for securing the sole 12 to the wearer's foot. In the illustrated embodiment, the upper 14 generally includes a strap 30 and a heel assembly 32 that and a strap 30. As shown in FIG. 1, the strap 30 crosses back and forth over the forefoot and midfoot to retain a wearer's foot. Opposite free ends of the strap 30 are secured to the heel assembly 32 with the intermediate portion being threaded through the midsole 18 at different locations to form loops above the midsole 18. In this embodiment, the first free end of strap 30 is attached to the heel assembly 32 on the medial side of the sandal 10. From there, the strap 30 extends over the top of the midfoot and forefoot, and then down through through-slot 40*f* on the lateral side of the midsole 18. The strap 30 continues from the lateral side along the bottom of the midsole 19 through channel 64*b* to the medial side, and then up through through-slot 40*e*. After emerging from through-slot 40*e* on the medial side of the midsole 18, the strap 30 extends over the top of the foot to the lateral side and then down through through-slot 40-*d*. On the bottom of the midsole 18, the strap 40 continues through strap channel 64*a* from the lateral side to the medial side and then up through through-slot 40*c*. After emerging from through-slot 40*c* on the medial side of the midsole 18, the strap 30 extends back over the top of the wearer's foot and its opposite end is affixed to the lateral side of the heel assembly 32. The second free end of the strap 30 may be joined to the heel assembly 32 using a length-adjustment arrangement. For example, the strap 30 may include a buckle 90 that is joined to the heel cradle 32 by an adjustment strap segment 92. As shown in FIG. 1, the adjustment strap segment 92 may be fed through the buckle 90 in a conventional manner in such a way as to allow the effective length of the strap 30 to be adjusted by varying the length of the portion of the adjustment strap segment 92 that is situated between the buckle 90 and the heel assembly 32. In this embodiment, the strap 30 is capable of lengthwise movement through the passages in the midsole 18, and more specifically through the strap inserts 20*a-b*. This permits the various loop segments of the strap 30 to be adjusted relative to one another and therefore allows the strap 30 to provide a custom fit to any foot. The amount of force required to make lengthwise adjustments to the strap 30 may be varied by adjusting the fit of the strap 30 through the strap inserts 20*a-b* and the supplemental slots 94 defined in the midsole 18. For example, a tighter fit may be used increase the resistance to movement of the strap 30 and a looser fit may be provided to make movement easier. The illustrated strap arrangement is merely exemplary and the present invention may be implement in sandals having other strap arrangements.

Figure 8:
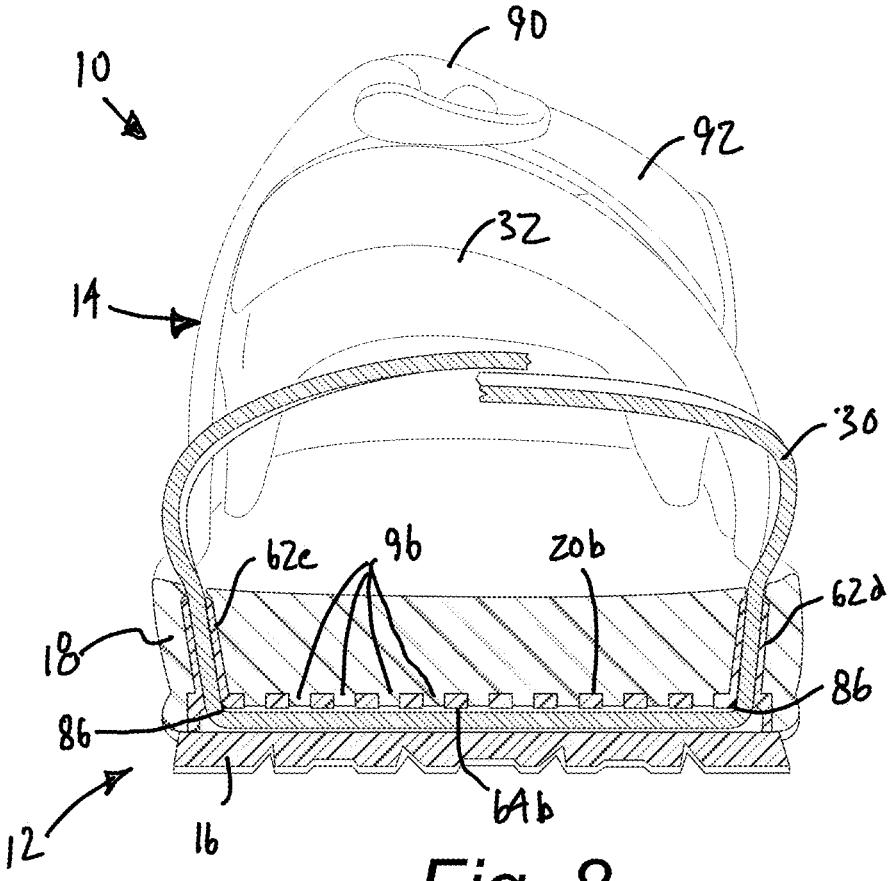
FIG. 8 is sectional view of the sole taken along line VIII-VIII of FIG. 1.

The midsole 18 is configured to receive the heel assembly 32. As shown in FIG. 8 and noted above, the midsole 18 defines vertical through-slots 40*a-b* that extend through the thickness of the midsole 18 along opposite sides of the midsole 18 and a bottom recess 41 that extends along the undersurface of the midsole 18 joining the lateral and medial vertical channels 40*a-b*. The vertical through-slots 40*a-b* and the bottom channel 41 collectively define a space that receives the lateral and medial ends of the heel assembly 32. For example, in the illustrated embodiment, the heel assembly 32 includes attachment ends 33 that extend down through the vertical through-slots 40*a-b* and wrap under the midsole 18 into the bottom channel 41 from opposite sides. The attachment ends 33 are secured in place, for example, by cement or other adhesives. FIG. 7 shows a layer of cement 88 disposed between the attachment ends 33 and the midsole 18.

In use, the heel assembly 32 is configured to receive the heel portion of the wearer's foot. The design and configuration of the heel assembly 32 may vary from application to application. However, in the illustrated embodiment, the heel assembly includes lateral and medial posts 50 that joined by a heel strap 52. The lateral and medial posts 50 each include an attachment end 33 that is secured to midsole 18. In this embodiment, each attachment end 33 extends through the through-slot 40*a-b* and is folded into a portion of the bottom recess 41. The attachment ends 33 are sandwiched between the midsole 18 and the outsole 16, for example, in adjacent portions of the bottom recess 41. The attachment ends 33 may be cemented to the midsole 18 along the entire length of bottom recess 41 and, if desired, the vertical channels 40*a-b*. Additionally, the attachment ends 33 may be cemented to the outsole 16.

Exemplary Manufacturing Process

A sandal in accordance with the present invention may be manufactured using a wide variety of manufacturing methods and equipment. For purposes of disclosure, one method for manufacturing the sandal 10 of FIG. 1 will be described generally, but alternative manufacturing methods and equipment may be used.

In the illustrated embodiment, the outsole 16 is generally conventional and may be manufactured by using conventional outsole manufacturing techniques and apparatuses. The outsole 16 may be manufactured as a single unitary sole component, or it may include separate parts that cooperate to form the outsole 16. For example, the outsole 16 may include parts of different hardness, different color or other different characteristics. The outsole 16 of the illustrated embodiment is injection or pour molded from a hard durable rubber using conventional molding apparatuses. The outsole 16 can be manufactured from other durable outsole materials. The tread pattern is formed during the molding operation as an integral part of the outsole 16.

The strap inserts 20*a-b* are injection molded from TPU or other similar materials. For example, each strap insert 20*a-b* may be molded with the web 60*a-b* and uprights sleeves 62*a-d* formed as a single unitary component. The perforations 96 may be formed during the injection molding process or they may be added to the web 60*a-b* after injection molding.

In the illustrated embodiment, the midsole 18 is manufactured using a compression molding process that is designed to allow the midsole 18 to be compression molded in direct contact with the strap inserts 20*a-b*. In this implementation, the bottom mold part includes interior features designed to receive and hold the strap inserts 20*a-b* in the appropriate locations within the compression mold. For example, the bottom mold part may include for each strap insert 20*a-b* interior mating features configured to interfit with the recess in the web and the passages through the upright sleeves. The mold part features that extend through the upright sleeves may continue beyond the upper end of the upright sleeves to function as a core to define the remainder of the vertical passages through the midsole. In this embodiment, the bottom mold part also include interior features that define the heel assembly through-slots 40*a-d* and the bottom recess 41. To form the midsole 18, a midsole preform containing and appropriate volume of the desired midsole material (e.g. EVA in the illustrated embodiment) is placed in the interior of the compression mold. The compression mold is then operated applying pressure and heat to compress and reshape the preform into the desired midsole 18. During this operation, the preform is compressed into the strap inserts 20*a-b* with sufficient pressure and heat for the midsole 18 and the strap inserts 20*a-b* to become intimately joined. The bond between the two components is enhanced by the perforations 96 in the web 60*a-b*. For example, as shown in FIGS. 7 and 8, the midsole material extends into the perforations 96 and bonds with the surrounding walls. In alternative applications, the midsole 18 may be formed separately from the strap inserts 20*a-b*, and the strap inserts 20*a-b* may be later cemented or otherwise bonded to the midsole 18. In alternative applications of this type, the bottom mold part may include interior features that are shaped to form the midsole with voids configured to receive and seat the strap inserts. If desired, the surface of the bottom mold part may be textured to provide the bottom surface of the midsole 18 with a rough surface to enhance the adhesive bond with the outsole 16.

The heel assembly 32 may be manufactured using conventional techniques and apparatus. For example, the heel assembly 32 may be assembled from different layers of material that provide adequate structure and a comfortable interface with the wearer's foot. For example, the heel assembly 32 may include a structural layer, a cushioning layer and a soft, yet durable, lining material. If desired, the heel strap may include an extra layer of padding selected to provide additional comfort. In this embodiment, the lateral and medial posts include attachment ends 33 that are cemented in place within the through-slots 40*a-b* and bottom recess 41. A layer of cement may be applied between the outsole 16 and the attachment ends 33, if desired.

The strap 30 of the illustrated embodiment, including the buckle and adjustment segment, is generally conventional and will not be described is extensive detail. Suffice it to say that the strap 30 is manufactured from a conventional nylon webbing or other similar materials. In this embodiment, the strap 30 is threaded through the midsole 18 (as discussed above) before the outsole 16 is attached to undersurface of the midsole 18.

The outsole 16 is attached to the bottom of the midsole 18, for example, by cement or other adhesive. The cement or other adhesive may be applied over the entirety of the undersurface of the midsole 18 and the attachment ends 33 extending along the undersurface of the midsole 18.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A sandal comprising:

a sole having a heel region, a midfoot region and a forefoot region, the sole including a midsole and an outsole, the midsole having an upper surface, a lower surface and a thickness;

a first strap insert disposed along the bottom surface of the midsole, the first strap insert being of a rigid one-piece construction and having a rigid web and a pair of rigid upright sleeves, the web defining a downwardly-opening channel extending across at least a portion of the midsole, the upright sleeves being integral with and extending upwardly from opposite ends of the web through at least a portion of the thickness of the midsole, each upright sleeve defining an internal through-passage opening into the channel;

a heel assembly attached to the sole in the heel region, the heel assembly having a lateral post, a medial post and a heel strap extending between the lateral post and the medial post; and an adjustable-length strap affixed to the sole and the heel assembly, the strap having a first end affixed to the heel assembly on a lateral side and a second end affixed to the heel assembly on the medial side, the strap movably threaded through a first passage in the sole, the first passage being at least partially defined by the first strap insert, the strap extending through the channel in the web and through each of the upright sleeves.

2. The sandal of claim 1 wherein the upright sleeves extend vertically through only a portion of the thickness of the midsole.

3. The sandal of claim 2 wherein the web defines a plurality of perforations, the midsole extending into at least some of the perforations.

4. The sandal of claim 3 wherein the outsole is affixed to the midsole covering the strap insert, the outsole closing the channel in the web.

5. The sandal of claim 2 wherein the perforations are arranged in a regular repeating pattern over a majority of the web.

6. The sandal of claim 1 wherein the midsole and the strap insert are joined to one another through compression molding.

7. The sandal of claim 1 further including a second strap insert, the second strap insert being of a rigid one-piece construction and having a rigid web and a pair of rigid upright sleeves extending from opposed ends of the web, the web of the second strap insert defining a downwardly-opening channel, each upright sleeve of the second strap insert defining an internal through-passage opening into the channel of the second strap insert; and wherein the first strap insert is disposed in one of the forefoot region and the midfoot region and the second strap insert is disposed in the other of the forefoot region and the midfoot region.

8. The sandal of claim 7 wherein the sole defines a second passage through the midsole, the second passage being at least partially defined by the second strap insert.

9. The sandal of claim 8 wherein the strap extends through the channel in the web of the second strap insert and through each of the upright sleeves of the second strap insert.

10. The sandal of claim 9 wherein the outsole closes the channel in the web of the first strap insert and the channel in the web of the second strap insert.

11. The sandal of claim 10 wherein the midsole has a hardness in the range of about 40 Shore C to about 56 Shore C and the first strap insert has a hardness in the range of about 80 Shore A to about 100 Shore A.

12. The sandal of claim 11 wherein the strap overlaps itself in an X-configuration over the midsole in at least one of the midfoot region and the forefoot region.

13. The sandal of claim 12 wherein the first strap insert and the second strap insert are fully embedded with the sole.

14. The sandal of claim 13 wherein the first strap insert extends across the midsole forwardly from a lateral side to a medial side at an angle of about 20 degrees and the second strap insert extends across the midsole across forwardly from a medial side to a lateral side at an angle of about 25 degrees.

15. The sandal of claim 14 wherein the uprights are recessed at least about 3 millimeters below an upper surface of the midsole.

16. A sandal comprising:

a sole including:

an outsole having an upper surface and a ground engaging lower surface;

a midsole affixed to the upper surface of the outsole, the midsole having an upper surface, a lower surface and a thickness;

a first strap insert embedded within the midsole, the first strap insert being of a rigid one-piece construction and having a rigid web extending across at least a portion of the midsole in the midfoot region and a pair of rigid upright sleeves extending from opposite ends of the web through at least a portion of the thickness, the web of the first strap insert defining a downwardly opening channel and each of the upright sleeves of the first strap insert defining an internal through-passage opening into the channel of the first strap insert; and a second strap insert embedded within the midsole, the second strap insert being of a rigid one-piece construction and having a rigid web extending across at least a portion of the midsole in the forefoot region and a pair of rigid upright sleeves extending from opposite ends of the web through at least a portion of the thickness, the web of the second strap insert defining a downwardly opening channel and each of the upright sleeves of the second strap insert defining an internal through-passage opening into the channel of the second strap insert; and an upper including:

a heel assembly with a lateral post affixed to the sole, a medial sole affixed to the sole and a heel strap extend between the lateral post and the medial post; and an adjustable-length strap having a first end affixed to the lateral post of the heel assembly and a second end affixed to the medial post of the heel assembly, a first portion of the strap movably threaded through the first strap insert and a second portion of the strap movably threaded through the second strap insert.

17. The sandal of claim 16 wherein the upright sleeves extend vertically through only a portion of the thickness of the midsole.

18. The sandal of claim 17 wherein the web of the first strap insert and the web of the second strap insert are perforated, the midsole extending into the perforations in the first strap insert and the second strap insert.

19. The sandal of claim 18 wherein the downwardly opening channels are closed by the outsole.

20. The sandal of claim 19 wherein the web and the uprights of the first strap insert are joined at corners, the corners being rounded to provide a smooth corner facilitating movement of the strap about the corners.

* * * * *